US009822641B2

(12) United States Patent
Dowling et al.

(10) Patent No.: US 9,822,641 B2
(45) Date of Patent: Nov. 21, 2017

(54) MINE DEWATERING SYSTEM AND METHOD

(75) Inventors: Jeremy Dowling, Tucson, AZ (US); Geoff Beale, Shrewsbury (GB)

(73) Assignee: WSP GLOBAL, INC., Montreal (CA)

( * ) Notice: Subject to any disclaimer, the term of this patent is extended or adjusted under 35 U.S.C. 154(b) by 575 days.

(21) Appl. No.: 13/699,915

(22) PCT Filed: May 4, 2011

(86) PCT No.: PCT/IB2011/051983

§ 371 (c)(1),
(2), (4) Date: Apr. 8, 2013

(87) PCT Pub. No.: WO2011/148285

PCT Pub. Date: Dec. 1, 2011

(65) Prior Publication Data

US 2013/0192822 A1 Aug. 1, 2013

Related U.S. Application Data

(60) Provisional application No. 61/348,564, filed on May 26, 2010.

(51) Int. Cl.
*E21B 43/30* (2006.01)
*E21F 16/02* (2006.01)
(Continued)

(52) U.S. Cl.
CPC ..... *E21F 16/02* (2013.01); *E02D 19/10* (2013.01); *E21B 43/121* (2013.01);
(Continued)

(58) Field of Classification Search
CPC ..... E21B 43/305; E02D 19/10; E21F 16/02
See application file for complete search history.

(56) References Cited

U.S. PATENT DOCUMENTS 3,269,326 A * 8/1966 Culleton et al. ..... 137/205.5
4,349,228 A 9/1982 Rohde
(Continued)

OTHER PUBLICATIONS

Nov. 8, 2015 Free Dictionary website printout—excavation.*
(Continued)

*Primary Examiner* — George Gray
(74) *Attorney, Agent, or Firm* — Law Office of Jesse D. Lambert, LLC

(57) ABSTRACT

A system and method for removing water from mine areas. In one embodiment, one or more directionally drilled dewatering wells are drilled into the geologic formation such that at least a portion of the dewatering well is positioned underneath the mine. In one embodiment, one or more of the dewatering wells may originate outside the perimeter of the mine so as not to interfere with mine operations. In one embodiment, a hydrogeologic assessment along with mine dewatering requirements may be used to generate a mine dewatering plan. In one embodiment, a hydrogeologic assessment along with a determination of the dewatering requirements of the mine and surrounding areas may be used to create a mine dewatering plan. In one embodiment, the mine dewatering plan provides design information pertaining to each dewatering well.

2 Claims, 4 Drawing Sheets

(51) Int. Cl.

| | |
|---|---|
| ***E02D 19/10*** | (2006.01) |
| ***E21F 16/00*** | (2006.01) |
| ***E21B 43/12*** | (2006.01) |
| *E02D 19/20* | (2006.01) |
| *E02D 19/06* | (2006.01) |

(52) U.S. Cl.
CPC ..... *E21B 43/305* (2013.01); *E21F 16/00* (2013.01); *E02D 19/06* (2013.01); *E02D 19/20* (2013.01)

(56) References Cited

U.S. PATENT DOCUMENTS

| | | | | |
|---|---|---|---|---|
| 4,637,479 | A | | 1/1987 | Leising |
| 4,986,696 | A | | 1/1991 | Pera et al. |
| 5,050,679 | A | * | 9/1991 | George ..... E21B 33/13 166/285 |
| 5,289,888 | A | * | 3/1994 | Talley ..... 175/61 |
| 5,452,759 | A | | 9/1995 | Carter et al. |
| 5,474,126 | A | | 12/1995 | Lynde et al. |
| 6,026,899 | A | | 2/2000 | Arizmendi et al. |
| 6,755,248 | B2 | | 6/2004 | Toulouse et al. |
| 6,968,893 | B2 | | 11/2005 | Rusby et al. |
| 2003/0221836 | A1 | | 12/2003 | Gardes |

OTHER PUBLICATIONS

May 25, 2016 Miriam-Webster Online Dictionary Excerpt—INTERSECT.*

Mansel, et al, "Dewatering of Opencast Mines Using Horizontal Wells", International Mine Water Association Annual Conference, 2012, pp. 574A-574I.

* cited by examiner

MINE DEWATERING SYSTEM AND METHOD

FIELD OF THE INVENTION

The present invention relates generally to mining operations and, more particularly, to a system and method of mine dewatering using directional drilling.

BACKGROUND

Open pit and underground mines that are developed beneath the groundwater table typically need to be dewatered. Dewatering is required in order to minimize water inflow to the operations, reduce operating costs, improve geotechnical performance of the mine, and create a safe working environment. Vertical pumping wells may be used in order to lower groundwater heads in advance of mining operations, and, in some cases, lower gravity flow in horizontal drains drilled into the mine walls from a surface within the mine.

However, vertical pumping wells are often difficult to implement and maintain for several reasons, including: (1) bedrock hydrogeology may be compartmentalized by subvertical faults and contacts, which may result in individual wells having limited hydrogeologic influence and productivity; and (2) wells may need to be placed directly within mine operating areas such that they may be destroyed or damaged by the advancing mine resulting in down-time of the dewatering system and frequent replacement and/or repair.

There remains a need for a mine dewatering system and method capable of removing water from mine areas in an efficient and cost effective manner.

SUMMARY

Accordingly, a system and method capable of efficiently and effectively removing water from mine areas are disclosed. In one embodiment, one or more dewatering wells are drilled into the geologic formation such that at least a portion of the dewatering well is positioned underneath the mine. In one embodiment, this is accomplished using a directional drilling arrangement.

In one embodiment, one or more submersible pumps may be positioned inside the well to allow water collected therein to be pumped to the surface and away from the mine. In one embodiment, one or more directionally drilled dewatering wells may be collared away from the perimeter of the mine so as not to interfere with mine operations. In one embodiment, at least a portion of the dewatering well is positioned directly underneath the deepest portion of the mine or a targeted phase of mining.

In one embodiment, the dewatering well(s) may be directionally drilled to a position underneath the water table of the geologic formation. Further, in one embodiment, dewatering wells may be drilled in a manner so as to intersect water bearing underground compartments located within the formation.

In one embodiment, a hydrogeologic assessment along with a determination of the dewatering requirements of the mine and surrounding areas may be used to create a mine dewatering plan. In one embodiment, the mine dewatering plan provides design information pertaining to each dewatering well.

The present embodiments offer a number of advantages over the use of vertical dewatering wells. For example, the directionally drilled dewatering wells are capable of: (1) targeting areas directly beneath the mine or targeted phase of mining, where the maximum amount of storage removal and drawdown is needed; (2) intercepting and collecting upgradient recharge water; and (3) operating on a continual basis due to their origination outside of the mine perimeter.

DETAILED DESCRIPTION

Figure 1:
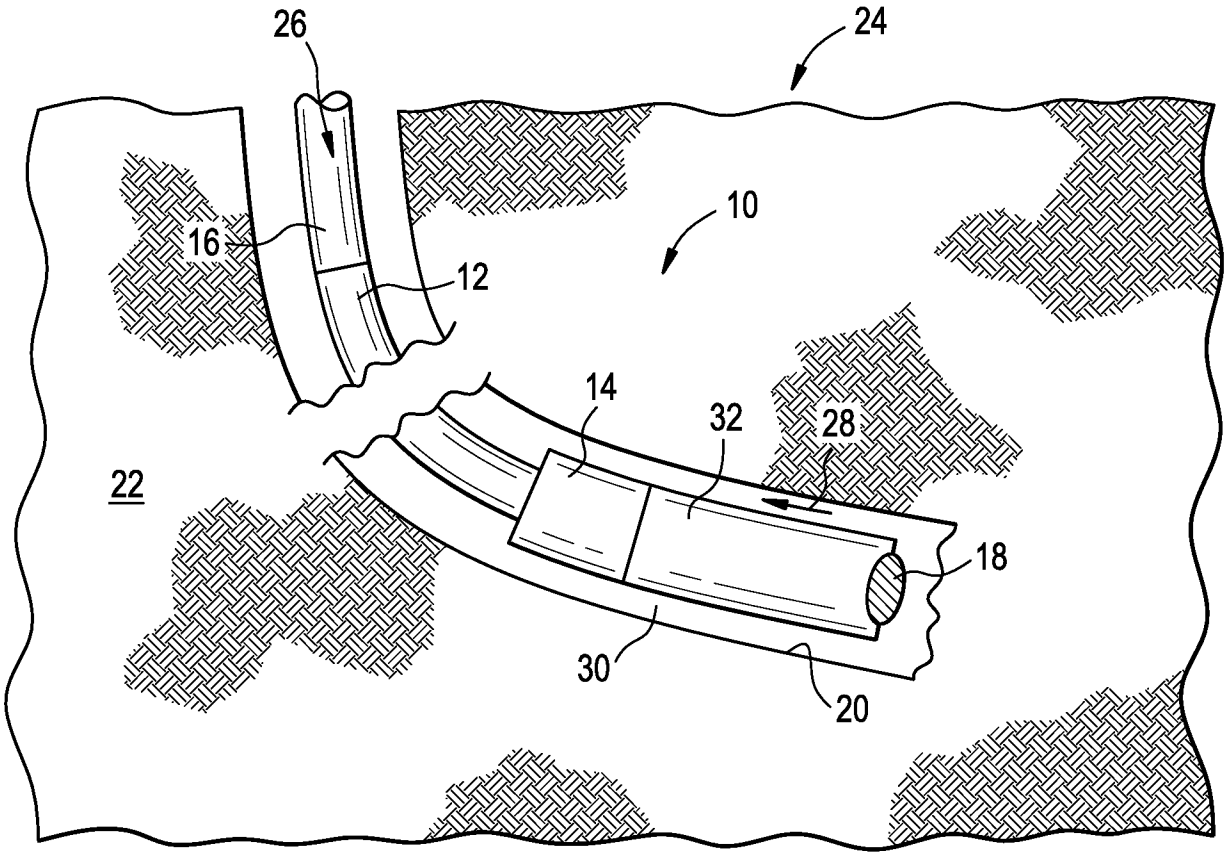
FIG. 1 is an example directional drilling system of one embodiment.

The present embodiment is herein described as a method of dewatering a mine and as a mine dewatering system. FIG. 1 illustrates an example directional drilling system (10) having a tubular drill string (12) with one or more drill collars (14) and multiple joints of drill pipe (16). One or more drill bits (18) may be coupled to the lower end of the drill string and operatively arranged for excavating a borehole (20) through various subsurface earth formations (22) in response to rotation of the drill string (12). As the drill string (12) is being rotated by a drilling rig or other drilling apparatus (not shown) at the surface (24), a substantial volume of a suitable drilling fluid (26) or a so-called "mud" may be pumped downwardly through the tubular drill string.

The mud (26) may then be subsequently discharged from multiple fluid passages in the drill bit (18) for cooling the bit as well as for carrying formation materials removed by the bit to the surface as the drilling mud is returned upwardly (as shown by the arrow 28) by way of the annulus (30) located between the borehole (20) and the drill string (12). Additional functionality (32) may be used to facilitate the utilization and servicing of the example directional drilling system (10) shown in FIG. 1. Directional drilling systems, such as the example of FIG. 1 are described in greater detail in U.S. Pat. No. 4,637,479 to Leising, entitled "Methods and Apparatus for Controlled Directional Drilling of Boreholes," the disclosure of which is incorporated by reference herein. It should be understood that the present embodiment may utilize any suitable directional drilling system/method and is not limited to the examples provided herein.

Figure 2:
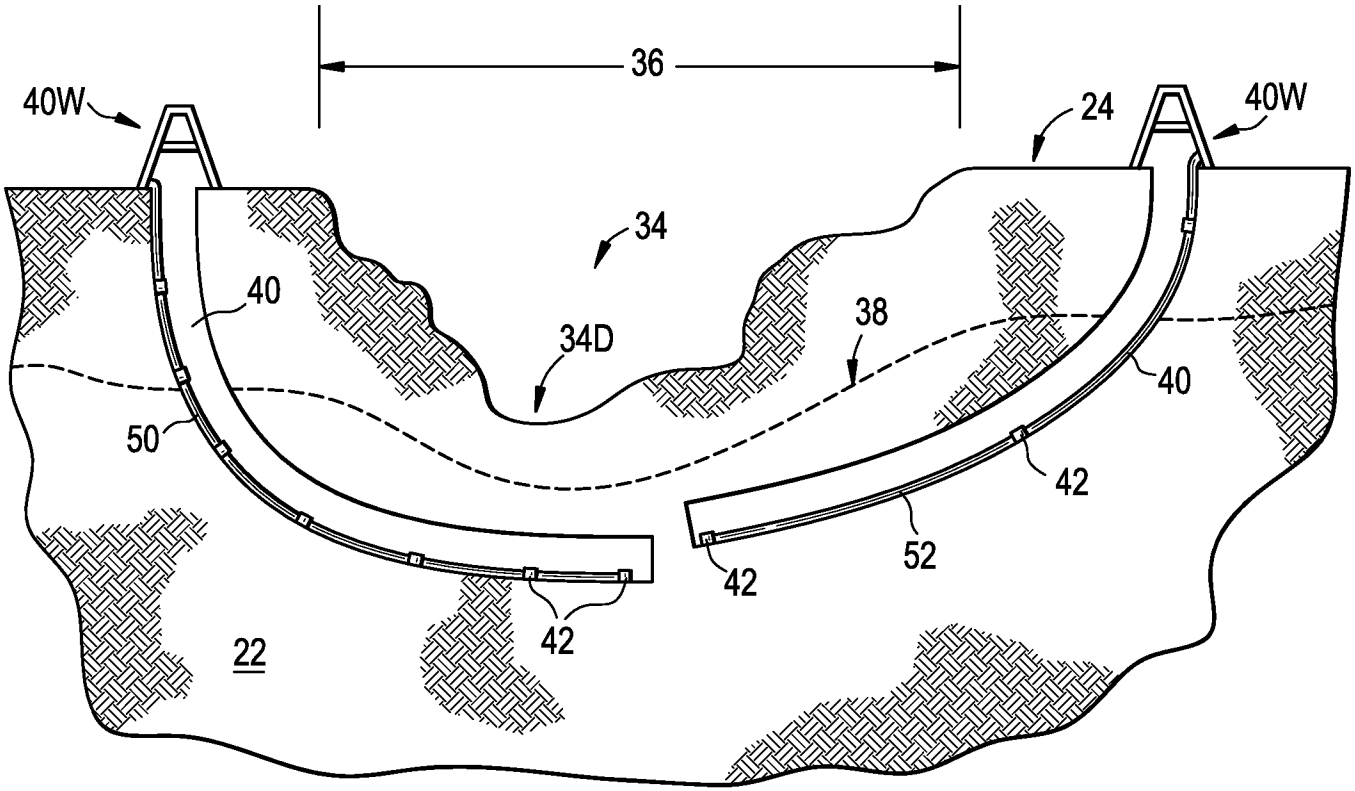
FIG. 2 is a cross sectional view of an example Earth formation of one embodiment.
Figure 3:
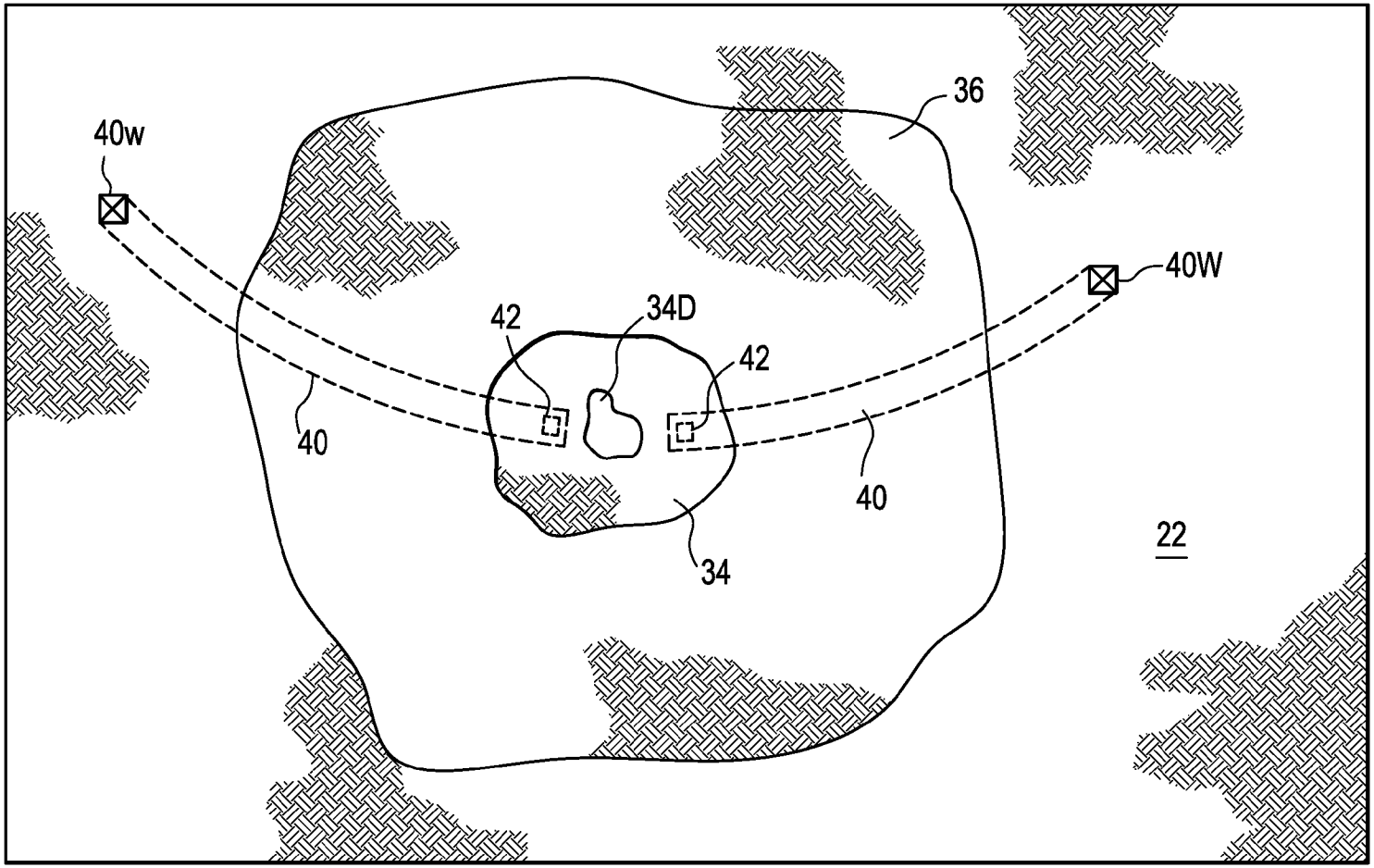
FIG. 3 is a top view of the example Earth formation of FIG. 2.

FIGS. 2 and 3 illustrate a cross sectional view and a top view (respectively) of an example geologic formation (22) containing an open pit mine (34) having perimeter (36). In one embodiment, the perimeter is the geographic area utilized by mine personnel to operate and maintain the mine (34). Mine development may result in penetration of the local or regional water table (38) causing an inflow of water into the mine (34), which can become, at best, a nuisance to mining operations and, at worst, a hazard to mine operations and personnel. Dry working conditions within the mine (34) are preferred as such conditions reduce wear and tear on machinery, reduce earth moving costs, and improve slope stability.

In one embodiment, one or more dewatering wells (40) may be drilled into the formation (22) using a directional drilling system such as that described above in reference to FIG. 1. In one embodiment, at least a portion of the dewatering well is positioned substantially underneath the mine (34), substantially underneath the selected phase of mining, and/or substantially underneath the mine's perimeter (36). The positioning of the dewatering well (40) substantially underneath the mine (34), substantially underneath the selected phase of mining, and/or substantially underneath the perimeter (36) of the mine allows water which may otherwise affect mine operations to be collected within the dewatering well. In one embodiment, at least a portion of the dewatering well is positioned directly underneath the deepest portion of the mine (34D).

In one embodiment, one or more submersible pumps (42) may be positioned within the dewatering well in order to pump water collected inside the dewatering well away from the mine (34). In one embodiment, the well head (40W) of one or more of the dewatering well(s) (40) may be positioned outside of the perimeter (36) of the mine (34). This feature prevents interference with mine operations and allows dewatering operations to proceed even as mine operations expand. In one embodiment, submersible pumps may be equipped with motors as well as variable frequency drive systems to allow for pumping head and flow variability.

In one embodiment, multiple dewatering wells may be utilized in order to provide the desired dewatering effect. The number and placement of each dewatering well (40) may depend on the hydrogeologic characteristics of the formation (22), including the location of the water table (38).

Figure 4:
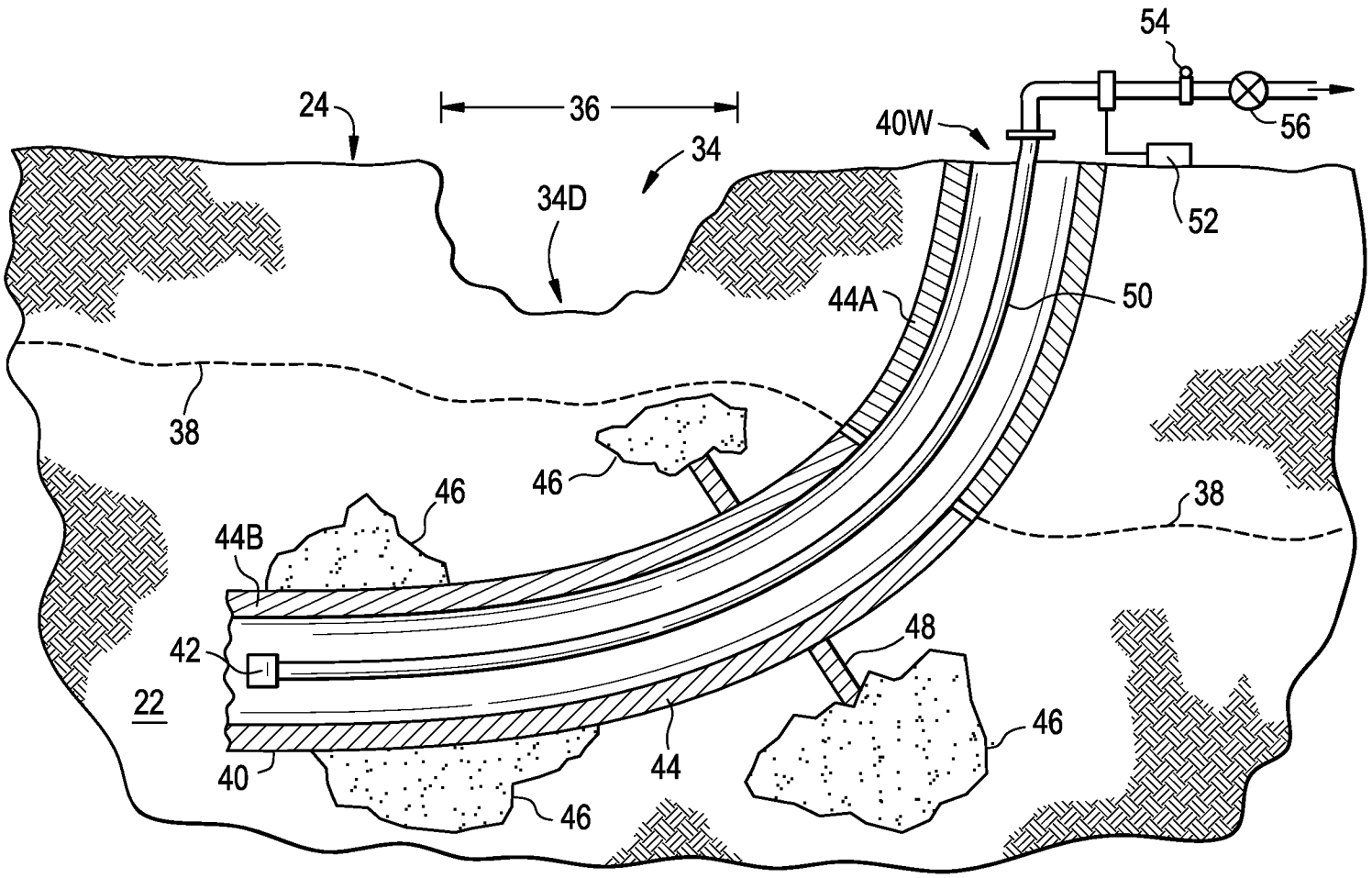
FIG. 4 is a cross sectional view of an example Earth formation of one embodiment.

FIG. 4 illustrates one embodiment wherein a dewatering well (40) has been directionally drilled into the formation (22) substantially underneath the mine or selected phase of mining, and equipped with casing (44). In one embodiment, the dewatering well (40) may be equipped with one or more slotted screens (not shown) such that the dewatering well is in communication with water contained within formation (22). In one embodiment, one or more slotted screens may be used to construct all of part of the well casing (44). In one embodiment, a slotted screen may be installed as the well liner material for the entire well section residing beneath the water table (38) of the formation (22). In this embodiment, two sections of well casing (44) may be utilized. A first well casing section (44A) above the water table composed of a blank well casing and a second well casing section (44B) positioned below the water table (38) composed of one or more slotted screens capable of allowing water to flow from the formation (22) into the well (40).

In one embodiment, the dewatering well(s) (40) may be drilled and/or perforated in a manner so as to intersect one or more water bearing hydrogeologic compartments or faults (46) in the formation (22). This feature increases well productivity as well as the area of influence for each dewatering well.

The directional dewatering wells (40) are capable of removing groundwater stored in the formation to be mined, within the perimeter of the mine, and also from the mine slopes left in-situ in areas immediately surrounding the mine operation. Further, the dewatering well(s) may be drilled and/or perforated in such a manner so as to intersect naturally occurring cross connects (48) in the formation (22) that are in communication with and/or interconnect one or more water bearing compartments (46).

After the well casing (44) has been perforated, a pipe and pump structure may be lowered into the well (40). In one embodiment, the pipe and pump structure includes a riser or discharge pipeline (50). Water within the mine (34) and/or the surrounding formation (22) may the well via the slotted screen(s) constructed as part of the well casing (44). The water then travels into the submersible pump (42) positioned inside the well (40) whereupon the water may be pumped upward to the surface via the riser pipe (50).

The submersible pump(s) (42) may be coupled to the riser pipe (50) such that water collected in the well may be pumped away from the mine. In one embodiment, an electrical control cabinet (52) may be utilized to monitor and control the dewatering operation, including the flow of water out of the discharge pipe (50), using flow meters (54), control valves (56) and other suitable monitoring equipment coupled to the riser pipe (50).

In one embodiment, a hydrogeologic assessment along with a determination of the dewatering requirements of the mine and surrounding areas may be used to create a mine dewatering plan. In one embodiment, the mine dewatering plan provides information regarding the design of each dewatering well.

In one embodiment, a hydrogeologic assessment of the mine and surrounding areas may be conducted prior to and/or in conjunction with mine dewatering operations. In one embodiment, a variety of data may be utilized in order to assess the hydrogeologic properties of the formation such as geologic block modeling data, Rock Quality Designation (RQD) modeling data, piezometric data, core inspection data, pilot hole testing data, spatial estimates of total clay, rock hardness and penetrations rates, etc. Data pertaining to the recharge characteristics of the formation may also be utilized.

For example, RQD data may provide information regarding the amount of fracturing at various levels of the formation. In one embodiment, RQD data may be input to a geologic block model, up-scaled and analyzed. RQD data regarding the nature of bedrock fracturing, i.e., the presence and type of fill material, frequency and size of fractures, may be helpful in determining the permeability of rocks within the formation.

In addition, core samples may be inspected to gain a qualitative understanding of the nature of fracturing for different RQD classifications. Piezometric data may be utilized to provide guidance regarding likely groundwater flow within the formation, pumping response in one or more test wells, and/or the uniformity of water drawdown during pumping operations. In one embodiment, the hydrogeologic assessment provides information regarding the location, permeability, continuity, connectivity, and orientation of geologic units, faults, and contacts within the formation as well as the compartmentalization of geologic systems within the formation so that directional drilled dewatering wells may be positioned optimally.

In one embodiment, the alignment of the dewatering well(s) may be designed according to a 3D arrangement utilizing geologic block models and/or RQD data sets. Dewatering wells may be aligned and steered through optimally fractured materials with interpreted hydraulic effectiveness, during the drilling process, using the block model as a guide. This feature helps ensure that the dewatering well(s) intersects productive groundwater zones.

In one embodiment, the hydrogeologic assessment of the formation may be utilized to determine and/or update one or more dewatering requirements for the mine operation. In one embodiment, an interpretive and/or analytical approach may be used to predict bedrock dewatering production pumping requirements for the mine. In one embodiment, upper and lower predictive estimates may be made by reviewing flow variations as they pertain to key parameters such as groundwater storage removal, inflow from the local or regional groundwater system, local recharge due to infiltration of incident precipitation, and/or surface water runoff. In one embodiment, datasets used for such estimates may include information relating to future mine plans, current groundwater levels, local topographic information, historical climate data, and/or the performance of the dewatering system to date.

In one embodiment, the mine operational plan may be used to calculate the annual block of bedrock that requires drainage to maintain dewatered conditions. Block(s) requiring dewatering may be extended beyond the perimeter of the mine, e.g., to the limits of observed response in the formation, based on prior observed dewatering performance.

Back-analysis of previous dewatering operations in the mine area may also be taken into account by defining the applicable cone of depression using piezometer data. The volume of dewatered bedrock may then be estimated and the required bedrock drainable porosity required to support the volume of water pumped from the area may then be determined.

Inflow from the local or regional groundwater system may also be taken into account in order to determine the dewatering production pumping requirements for the mine. As the mine floor is deepened and dewatered progressively over time, an increasing hydraulic gradient between the mine and local water system may develop. Further, the potential for vertical water leakage from the geologic sequence into the bedrock and mine area may increase. The rate at which groundwater from the local water system flows into the mine area may be controlled, at least in part, by the permeability of the bounding structures and/or geologic units present in the formation. In many cases, water inflow from the local water system may increase as the mine deepens into the formation.

In one embodiment, dewatering requirements may be expressed according to any suitable arrangement. In one embodiment, mine dewatering requirements may be expressed in terms of the required dewatering according to a gallons versus time arrangement over the expected duration of the mine operation. Graphs and/or charts illustrating the required dewatering requirements of the mine may be prepared to graphically illustrate the dewatering requirements of the mine operation.

The hydrogeologic assessment, the mine dewatering requirements, and other applicable information concerning the mine may be used to generate a mine dewatering plan, including the use of directionally drilled dewatering wells. In one embodiment, the mine dewatering plan addresses each dewatering objective as well as the optimal design parameters for each proposed dewatering well including information such as the number of dewatering wells to be used, where the wells are to be drilled, etc.

What is claimed is:

1. A method of dewatering a mine comprising the steps of:

a) directionally drilling a first well into a formation adjacent to said mine, acquiring hydrogeologic assessment data from said well, and conducting a hydrogeologic assessment of said formation;

b) evaluating said hydrogeologic assessment data to determine at least one directional well path that would encounter at least one geologic zone proximal said mine, said hydrogeological assessment identifying a geologic zone appearing to be in fluid communication with said mine and having at least high permeability;

c) directionally drilling a at least one additional well along the determined at least one directional well path, such that at least a portion of said well is positioned substantially underneath said mine such that at least a portion of said well is capable of collecting water from said formation;

d) positioning one or more submersible pumps inside said well;

e) collecting water inside said well, prior to at least a portion of said water entering said mine; and f) pumping said water outside of said mine perimeter, wherein said well is drilled into said geologic formation so as to intersect one or more groundwater bearing underground compartments or one or more naturally occurring cross connects within said formation.

2. The method of claim 1, wherein the step of conducting a hydrogeologic assessment of said mine further comprises:

determining one or more dewatering requirements for said mine.

* * * * *